US006412294B2

(12) United States Patent
Kimura et al.

(10) Patent No.: US 6,412,294 B2
(45) Date of Patent: Jul. 2, 2002

(54) CONTROL DEVICE OF VARIABLE DISPLACEMENT COMPRESSOR

(75) Inventors: Kazuya Kimura; Masahiro Kawaguchi; Ken Suitou; Ryo Matsubara, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/755,395

(22) Filed: Jan. 5, 2001

(30) Foreign Application Priority Data

Jan. 7, 2000 (JP) ..... 2000-001601

(51) Int. Cl.[7] ..... F25B 1/00; F25B 27/00
(52) U.S. Cl. ..... 62/228.3; 62/229; 62/323.1
(58) Field of Search ..... 62/209, 228.3, 62/229, 323.1; 417/222.2

(56) References Cited

U.S. PATENT DOCUMENTS 5,191,768 A * 3/1993 Fujil ..... 62/229 X
5,884,497 A * 3/1999 Kishita et al.

FOREIGN PATENT DOCUMENTS

JP 4068055 * 6/1994 ..... 62/228.3
JP 6-341378 12/1994
JP 9-228948 9/1997

* cited by examiner

*Primary Examiner*—William Wayner
(74) *Attorney, Agent, or Firm*—Morgan & Finnegan, LLP

(57) ABSTRACT

A variable displacement compressor air conditions a compartment and includes a suction chamber, a discharge chamber and a crank chamber. A controller controls the pressure in the crank chamber to vary the compressor displacement. Two pressure monitoring points are located in a refrigerant circuit. The pressure in the crank chamber is controlled by a control valve. The control valve operates based on the pressure difference between the monitoring points such that a target pressure difference is maintained. A temperature sensor monitors the temperature of the compartment. A detection circuit compares the monitored temperature with reference values. When the monitored temperature surpasses one reference value or falls below another, the detection circuit outputs a detection signal. When receiving the detection signal, a pressure difference changer gradually increases or decreases the target value of the pressure differences accordingly.

15 Claims, 9 Drawing Sheets

CONTROL DEVICE OF VARIABLE DISPLACEMENT COMPRESSOR

BACKGROUND OF THE INVENTION

The present invention relates to a controller of a variable displacement compressor.

The refrigeration circuit of a typical vehicle air conditioner includes a compressor, such as a variable displacement swash plate type compressor. A typical variable displacement swash plate type compressor includes a displacement control mechanism for maintaining the pressure at the outlet of an evaporator, which will be referred to as the suction pressure Ps, at a target value, which will be referred to as target suction pressure. The displacement control mechanism feedback controls the displacement of the compressor, or the inclination angle of the swash plate, by referring to the suction pressure Ps such that the displacement corresponds to the cooling load. A typical displacement mechanism includes a displacement control valve, which is called an internally controlled valve. The internally controlled valve detects the absolute value of the suction pressure Ps by means of a pressure sensitive member such as a bellows or a diaphragm. The internally controlled valve moves a valve body by the displacement of the pressure sensing member to adjust the valve opening size. Accordingly, the pressure in a swash plate chamber (a crank chamber), or the crank pressure Pc is changed, which changes the inclination of the swash plate. However, an internally controlled valve that has a simple structure and a single target suction pressure cannot respond to the changes in air conditioning demands. Therefore, control valves having a target suction pressure that can be changed by external electrical control are becoming standard.

A typical electrically controlled control valve is a combination of an internally controlled valve and an actuator such as an electromagnetic solenoid, which applies an electrically controlled force. Mechanical spring force, which acts on the pressure sensing member is externally controlled to change the target suction pressure. The target suction pressure is changed by controlling a current to the electromagnetic solenoid in an analog or a digital manner. The supplied current is controlled by a controller having a microcomputer that is designed for air conditioning. Specifically, the controller executes a proportional and integral (PI) control procedure or a proportional, integral and differential (PID) control procedure based on temperature information from a temperature sensor located near the evaporator or in a passenger compartment for continuously controlling the current. As a result, the compressor theoretically maintains an ideal displacement, or a displacement that corresponds to the magnitude of the cooling load.

However, to execute a PI control procedure or a PID control procedure for continuously and finely controlling the target suction pressure, the controller, which includes a microcomputer, must continuously receive temperature information from the temperature sensor and compute the current supplied to a control valve. Thus, the controller must have a high-performance microcomputer to bear a high computation load. Even if the controller has a high-performance microcomputer, the controller receives temperature data relatively frequently (at an extremely short cycle). Thus, the controller cannot be used for other purposes, which increases the ratio of cost of the controller in the total cost of the compressor.

In a displacement control procedure in which the absolute value of the suction pressure Ps is used as a reference, changing of the target suction pressure by electrical control does not always quickly change the actual suction pressure to the target suction pressure. This is because whether the actual suction pressure quickly seeks a target suction pressure when the target suction pressure is changed greatly depends on the absolute magnitude of the cooling load. Therefore, even if the target suction pressure is finely and continuously controlled by controlling the current to the control valve, changes in the compressor displacement are likely to be too slow or too sudden.

SUMMARY OF THE INVENTION

Accordingly, it is an objective of the present invention to provide a control device of a variable displacement compressor that has a simple structure and improves the controllability and response of displacement control.

To achieve the foregoing and other objectives and in accordance with the purpose of the present invention, a controller for a variable displacement compressor, which is used for air conditioning a compartment, is provided. The compressor includes a suction pressure zone, a discharge pressure zone, and a control chamber, which is connected to the suction pressure zone and to the discharge pressure zone. The pressure in the control chamber is adjusted for controlling the displacement of the compressor. The controller includes a refrigerant circuit, a control valve, a detection circuit and a pressure difference changer. The refrigerant circuit is connected to the compressor. Two pressure monitoring points are located in the refrigerant circuit. The control valve controls the pressure in the control chamber. The control valve operates based on the actual pressure difference between the pressure monitoring points such that a target value of the pressure difference between the pressure monitoring points, which is externally determined, is maintained. The detection circuit includes a temperature sensor for monitoring a temperature that represents the temperature of the compartment. The detection circuit produces a first detection signal when the sensed temperature exceeds a threshold value and a second detection signal when the sensed temperature falls below the threshold value. The pressure difference changer gradually increases the target value of the pressure difference when the first signal is received from the detection circuit and gradually decreases the target value of the pressure difference when the second signal is received from the detection circuit.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment according to the present invention will now be described with reference to FIGS. 1 to 13.

Figure 1:
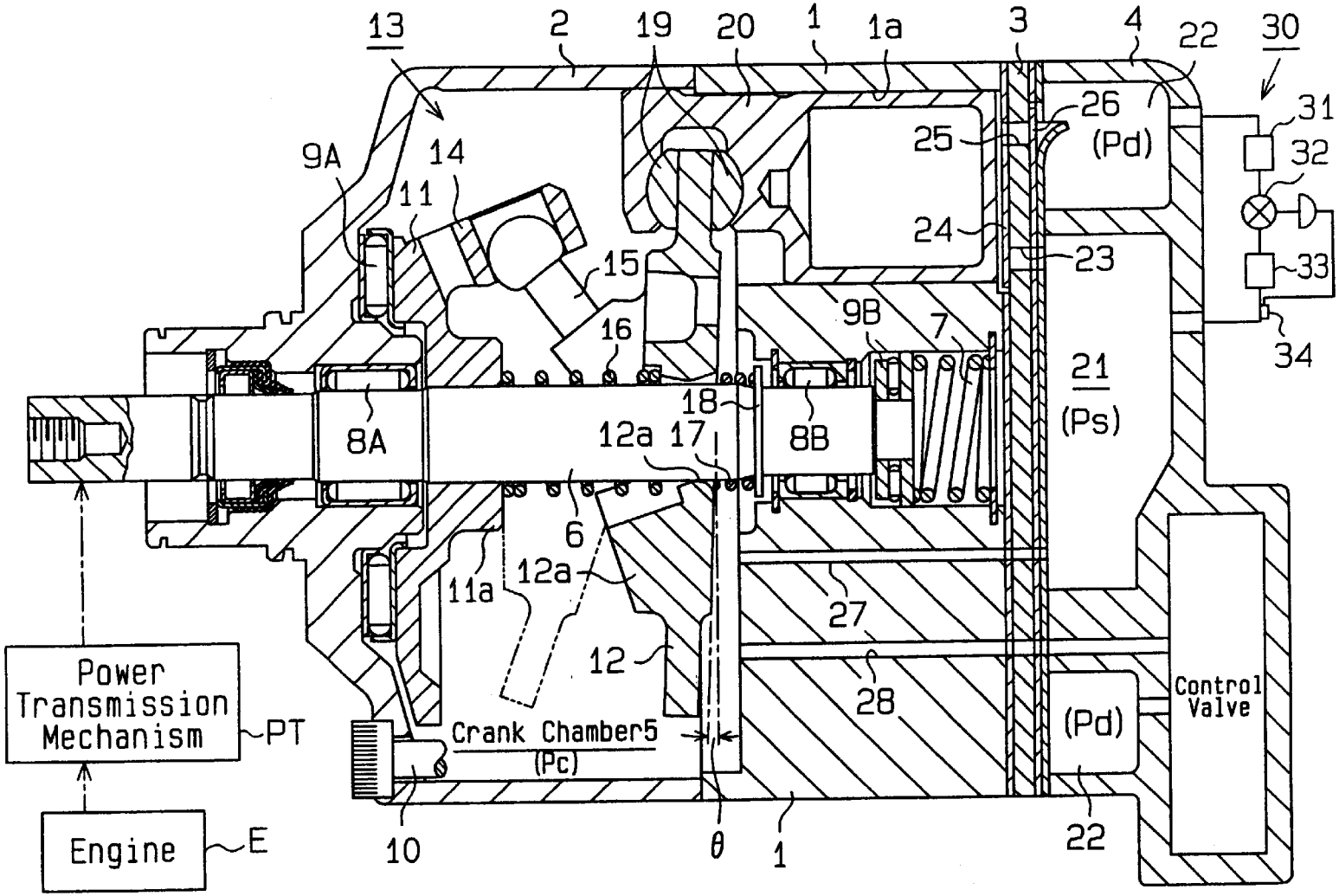
FIG. 1 is a cross-sectional view illustrating a variable displacement swash plate type compressor according to one embodiment of the present invention.

As shown in FIG. 1, a variable displacement swash plate type compressor includes a cylinder block 1, a front housing member 2, which is secured to the front end face of the cylinder block 1, and a rear housing member 4, which is secured to the rear end face of the cylinder block 1. A valve plate assembly 3 is located between the cylinder block 1 and the rear housing member 4. The cylinder block 1, the front housing member 2, the valve plate assembly 3 and the rear housing member 4 are secured to one another by bolts 10 (only one is shown) to form the compressor housing. In FIG. 1, the left end of the compressor is defined as the front end, and the right end of the compressor is defined as the rear end. A crank chamber 5 is defined between the cylinder block 1 and the front housing member 2. A drive shaft 6 extends through the crank chamber 5 and is supported through radial bearings 8A, 8B by the housing. A recess is formed in the center of the cylinder block 1. A coil spring 7 and a rear thrust bearing 9B are located in the recess. A lug plate 11 is secured to the drive shaft 6 to rotate integrally with the drive shaft 6. A front thrust bearing 9A is located between the lug plate 11 and the inner wall of the front housing member 2. The drive shaft 6 is supported in the axial direction by the rear bearing 9B, which is urged forward by the spring 7, and the front bearing 9A.

The front end of the drive shaft 6 is connected to an external drive source, which is a vehicle engine E in this embodiment, through a power transmission mechanism PT. In this embodiment, the power transmission mechanism PT is a clutchless mechanism that includes, for example, a belt and a pulley. The power transmission mechanism PT therefore constantly transmits power from the engine E to the compressor when the engine E is running. Alternatively, the mechanism PT may be a clutch mechanism (for example, an electromagnetic clutch) that selectively transmits power when supplied with a current.

As shown in FIG. 1, a cam plate, which is a swash plate 12 in this embodiment, is located in the crank chamber 5. A hole extends through the middle of the swash plate 12. The drive shaft 6 extends through the hole. The swash plate 12 is connected with the lug plate 11 and the drive shaft 6 through a coupling guide mechanism, which is a hinge mechanism 13 in this embodiment, to rotate integrally with the drive shaft 6. The hinge mechanism 13 includes two support arms 14 (only one is shown) and two guide pins 15 (only one is shown). Each support arm 14 projects from the rear side of the lug plate 11. Each guide pin 15 projects from the front side of the swash plate 12. The support arms 14 and the guide pins 15 cooperate to permit the swash plate 12 to rotate integrally with the lug plate 11 and the drive shaft 6. Contact between the drive shaft 6 and the wall of the swash plate center hole permits the swash plate 12 to slide along the drive shaft 6 and to tilt with respect to the axis of the drive shaft 6. The swash plate 12 has a counterweight 12*a* located at the opposite side of the drive shaft 6 from the hinge mechanism 13.

A spring 16 is located between the lug plate 11 and the swash plate 12. The spring 16 urges the swash plate 12 toward the cylinder block 1, or in a direction decreasing the inclination angle of the swash plate 12. A stopper ring 18 is fixed on the drive shaft 6 behind the swash plate 12. A return spring 17 is fitted about the drive shaft 6 between the stopper ring 18 and the swash plate 12. When the inclination angle is great as shown by the broken line in FIG. 1, the spring 17 does not apply force to the swash plate 12. When the inclination angle is small as shown by the solid line in FIG. 1, the spring 17 is compressed between the stopper ring 18 and the swash plate 12 and urges the swash plate 12 away from the cylinder block 1, or in a direction increasing the inclination angle. The normal length of the spring 17 and the location of the stopper ring 18 are determined such that the spring 17 is not fully contracted when the swash plate 12 is inclined by the minimum inclination angle θmin (for example, an angle from one to five degrees).

Several cylinder bores 1*a* (only one shown) are formed in the cylinder block 1 about the drive shaft 6. The rear end of each cylinder bore 1*a* is blocked by the valve plate assembly 3. A single headed piston 20 is reciprocally accommodated in each cylinder bore 1*a*. Each piston 20 and the corresponding cylinder bore 1*a* define a compression chamber, the volume of which is changed according to reciprocation of the piston 20. The front portion of each piston 20 is coupled to the swash plate 12 by a pair of shoes 19. Therefore, when the swash plate 12 rotate integrally with the drive shaft 6, rotation of the swash plate 12 reciprocates each piston 20 by a stroke that corresponds to the angle θ.

A suction chamber 21, which is included in a suction pressure zone, and discharge chamber 22, which is included in a discharge pressure zone, are defined between the valve plate assembly 3 and the inner wall of the rear housing member 4. The suction chamber 21 is located approximately in the center of the rear housing member 4, and the discharge chamber 22 surrounds the suction chamber 21. The valve plate assembly 3 includes a suction valve flap plate, a port plate, discharge valve flap plate and a retainer plate. The valve plate assembly 3 has suction ports 23 and discharge ports 25, which correspond to each cylinder bore 1*a*. The valve plate assembly 3 also has suction valve flaps 24, each of which corresponds to one of the suction ports 23, and discharge valve flaps 26, each of which corresponds to one of the discharge ports 25. Each cylinder bore 1*a* is connected to the suction chamber 21 through the corresponding suction port 23 and is connected to the discharge chamber 22 through the corresponding discharge port 25. Refrigerant gas is drawn from the outlet of the evaporator 33 to the suction chamber 21, where the pressure is a suction pressure Ps. When each piston 20 moves from the top dead center position to the bottom dead center position, refrigerant gas in the suction chamber 21 flows into the corresponding cylinder bore 1*a* via the corresponding suction port 23 and suction valve flap 24. When each piston 20 moves from the bottom dead center position to the top dead center position, refrigerant gas in the corresponding cylinder bore 1*a* is compressed to a predetermined pressure and is discharged to the discharge chamber 22, where the pressure is a discharge pressure Pd, via the corresponding discharge port 25 and discharge valve 26. The highly pressurized refrigerant in the discharge chamber 22 flows to the condenser 31.

Power from the engine E is transmitted to and rotates the drive shaft 6. Accordingly, the swash plate 12, which is inclined by an angle θ, is rotated. The angle θ is defined by the swash plate 12 and an imaginary plane that is perpendicular to the drive shaft 6. Rotation of the swash plate 12 reciprocates each piston 20 by a stroke that corresponds to the angle θ. As a result, suction, compression and discharge of refrigerant gas are repeated in the cylinder bores 1*a*.

The inclination angle θ of the swash plate 12 is determined according to various moments acting on the swash plate 12. The moments include a rotational moment, which is based on the centrifugal force of the rotating swash plate 12, a spring force moment, which is based on the force of the springs 16 and 17, a moment of inertia of the piston reciprocation, and a gas pressure moment. The gas pressure moment is generated by the force of the pressure in the cylinder bores 1*a* and the pressure in the crank chamber 5 (crank pressure Pc). Depending on the crank pressure Pc, the gas pressure moment acts either to increase or decrease the inclination angle θ of the swash plate 12.

The gas pressure moment is adjusted by changing the crank pressure Pc by a displacement control valve, which will be discussed below. Accordingly, the inclination angle θ of the plate 12 is adjusted to an angle between the minimum inclination θmin and the maximum inclination θmax. Contact between a counterweight 12*a* on the swash plate 12 and a stopper 11*a* of the lug plate 11 prevents further inclination of the swash plate 12 from the maximum inclination θmax. The minimum inclination θmin is determined based primarily on the forces of the springs 16 and 17 when the gas pressure moment is maximized in the direction in which the swash plate inclination angle θ is decreased.

As described above, the crank pressure Pc is related to changes of the inclination angle θ of the swash plate 12. A mechanism for controlling the crank pressure Pc includes a bleed passage 27, a supply passage 28 and the control valve. The passages 27, 28 are formed in the compressor housing. The bleed passage 27 connects the suction chamber 21 with the crank chamber 5. The supply passage 28 connects the discharge chamber 22 with the crank chamber 5. The control valve regulates the supply passage 28. Specifically, the opening of the control valve is adjusted to control the flow rate of highly pressurized gas supplied to the crank chamber 5 through the supply passage 28. The crank pressure Pc is determined by the ratio of the gas supplied to the crank chamber 5 through the supply passage 28 and the flow rate of refrigerant gas conducted out from the crank chamber 5 through the bleed passage 27. As the crank pressure Pc varies, the difference between the crank pressure Pc and the pressure in the cylinder bores 1*a* varies, which changes the inclination angle θ of the swash plate 12. Accordingly, the stroke of each piston 20, or the compressor displacement, is varied.

A slight clearance (not shown) exists between the inner wall of the each cylinder bore 1*a* and the corresponding piston 20. Each clearance connects the corresponding cylinder bore 1*a* with the crank chamber 5. The discharge pressure zone, which is connected to the crank chamber 5, includes the discharge chamber 22 and one or more of the cylinder bores 1*a* in which the piston 20 is in the compression stroke. When each piston 20 compresses the gas in the associated cylinder bore 1*a*, some of the refrigerant gas in the cylinder bore 1*a* leaks into the crank chamber 5 through the clearance between the cylinder bore 1*a* and the piston 20. The leaking gas is referred to as blowby gas. The blowby gas increases the pressure of the crank chamber 5. The discharge pressure zone in this embodiment includes the discharge chamber 22 and the cylinder bores 1*a*.

Figure 2:
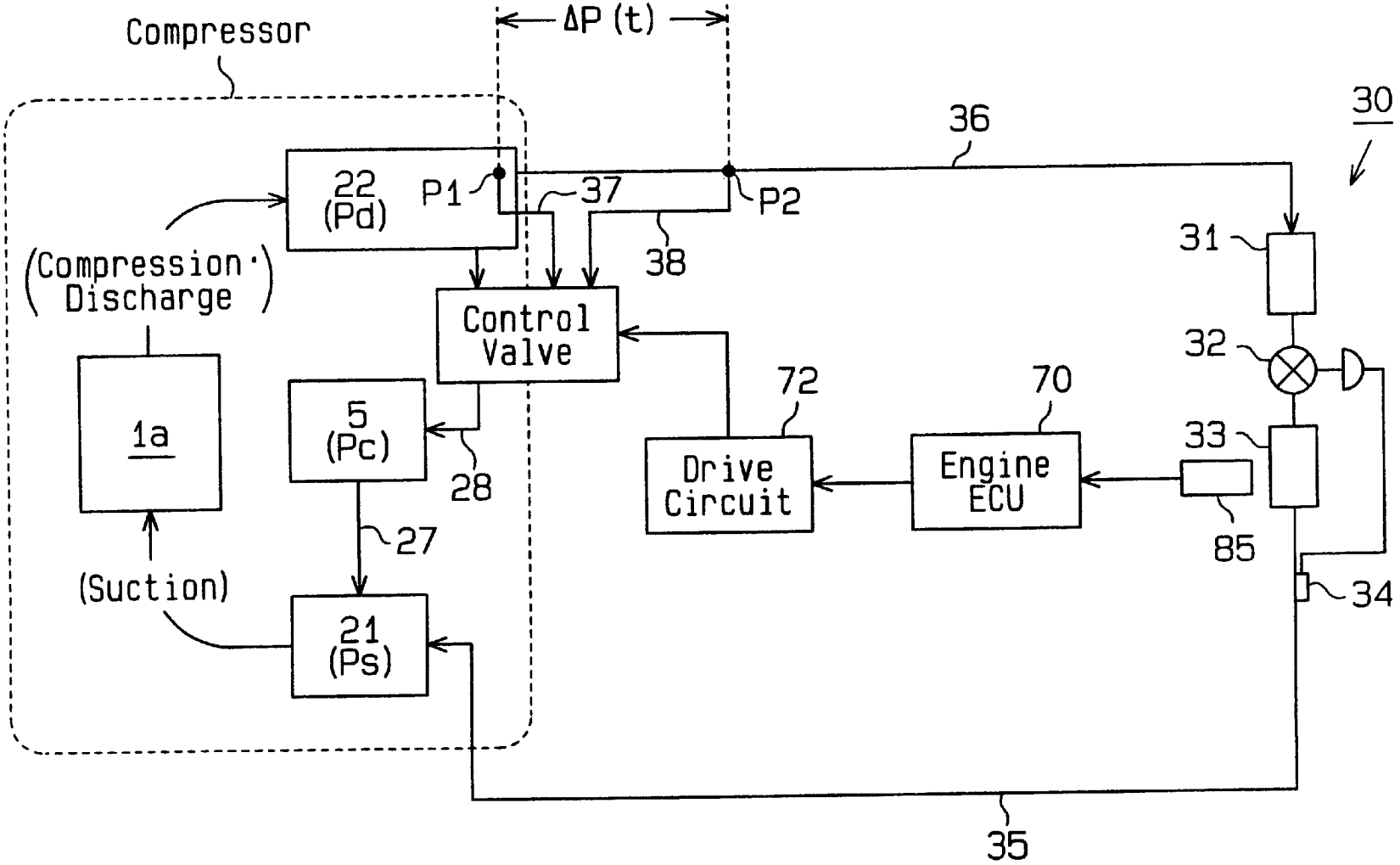
FIG. 2 is a schematic diagram illustrating a refrigeration circuit according to the embodiment of FIG. 1.

As shown in FIGS. 1 and 2, a refrigeration circuit, or a refrigerant circuit, of a vehicle air conditioner includes the variable displacement swash plate type compressor and an external refrigerant circuit 30. The external refrigerant circuit 30 includes, for example, a condenser 31, a decompression device and an evaporator 33. The decompression device is an expansion valve 32 in this embodiment. The opening of the expansion valve 32 is feedback-controlled based on the temperature detected by a heat sensitive tube 34 at the outlet of the evaporator 33 and the evaporation pressure, or the pressure at the evaporator outlet. The expansion valve 32 supplies liquid refrigerant to the evaporator 33 to regulate the flow rate in the external refrigerant circuit 30. The amount of the supplied refrigerant corresponds to the thermal load. A downstream pipe 35 is located in a downstream portion of the refrigerant circuit 30 to connect the outlet of the evaporator 33 to the suction chamber 21 of the compressor. An upstream pipe 36 is located in an upstream portion of the refrigerant circuit 30 to connect the discharge chamber 22 of the compressor to the inlet of the condenser 31. The compressor draws refrigerant gas from the downstream portion of the refrigeration circuit 30 and compresses the gas. The compressor then discharges the compressed gas to the discharge chamber 22, which is connected to the upstream portion of the circuit 30.

The greater the displacement of the compressor is, the higher the flow rate of refrigerant in the refrigeration circuit is. The greater the flow rate of the refrigerant is, the greater the pressure loss per unit length of the circuit is. That is, the pressure loss between two points in the refrigeration circuit corresponds to the flow rate of refrigerant in the circuit. Detecting the pressure difference ΔP(t) between two points P1, P2 permits the displacement of the compressor to be indirectly detected. In this embodiment, two pressure monitoring points P1, P2 are defined in the upstream pipe 36. The first pressure monitoring point P1 is located in the discharge chamber 22, which is the most upstream section of the upstream pipe 36. The second pressure monitoring point P2 is located in the upstream pipe 36 and is spaced from the first point P1 by a predetermined distance. A part of the control valve is exposed to the pressure PdH, or the discharge pressure Pd, at the first point P1 by a first pressure introduction passage 37. Another part of the control valve is exposed to a pressure PdL at the second point P2 by a second pressure introduction passage 38. The control valve feedback process uses the pressure difference expressed by ΔP(t)=PdH−PdL to estimate the compressor displacement and to feedback control the displacement.

Figure 3:
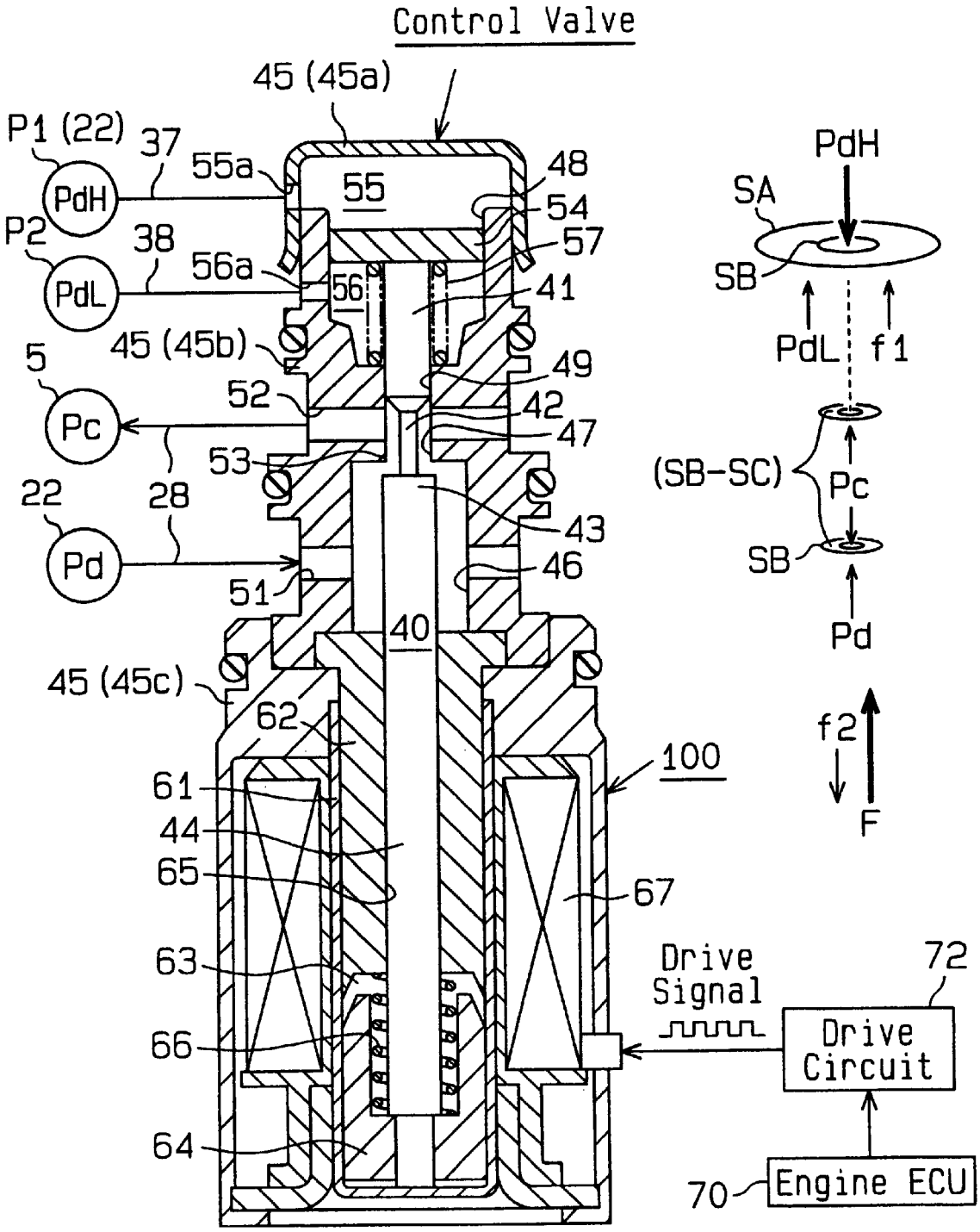
FIG. 3 is a cross-sectional view illustrating the control valve in the compressor of FIG. 1.

The displacement control valve shown in FIG. 3 mechanically detects the pressure difference between the pressure monitoring points P1, P2 and adjusts the valve opening based on the detected pressure difference.

As shown in FIG. 3, the control valve includes an inlet valve and a solenoid. The inlet valve is arranged in an upper portion of the valve, while the solenoid is arranged in a lower portion of the valve. The inlet valve adjusts the opening size (throttle amount) of the supply passage 28, which connects the discharge chamber 22 to the crank chamber 5. The solenoid is an electromagnetic actuator for urging a rod 40 located in the control valve based on current supplied from an outside source. The solenoid functions as an actuator 100 for changing a target pressure difference.

The rod 40 includes a distal portion 41, a coupler portion 42 and a proximal guide portion 44. The guide portion 44 includes a valve body 43, which is located in the center of the rod 40. The diameter of the distal portion 41, the coupler portion 42 and the guide portion 44 are represented by d1, d2 and d3, respectively. The diameters satisfy the inequality d2<d1<d3. The cross-sectional area SB of the distal portion 41 is represented by $\pi(d1/2)^2$. The cross-sectional area SC of the coupler portion 42 is represented by $\pi(d2/2)^2$. The cross-sectional area SD of the guide portion 44 is represented by $\pi(d3/2)^2$.

The control valve has a valve housing 45. The housing 45 includes a cap 45*a* and an upper portion 45*b* and a lower portion 45*c*. The cap 45*a* is fixed to the end of the upper portion 45*b*. The upper portion 45*b* defines the shape of the inlet valve portion. The lower portion 45*c* defines the shape of the solenoid. A valve chamber 46 and a communication passage 47 are formed in the upper portion 45*b*. A pressure sensing chamber 48 is defined between the upper portion 45*b* and the cap 45*a*.

The rod 40 extends through the valve chamber 46, the communication passage 47 an the pressure sensing chamber 48. The rod 40 moves axially, or in the vertical direction as viewed in the drawing. The valve chamber 46 is connected to the communication passage 47 depending on the position of the rod 40. The communication passage 47 is disconnected from the pressure sensing chamber 48 by a wall, which is a part of the valve housing 45. A guide hole 49 is formed in the wall to receive the rod 40. The diameter of the guide hole 49 is equal to the diameter d1 of the distal portion 41. The communication passage 47 is axially aligned with the guide hole 49, and the diameter of the communication passage 47 is equal to the diameter dl of the distal portion 41. That is, the area of the communication passage 47 and the area of the guide hole 49 are equal to the area SB of the distal portion 41.

The bottom of the valve chamber 46 is formed by the upper surface of a fixed iron core 62. A Pd port 51 extends radially from the valve chamber 46. The valve chamber 46 is connected to the discharge chamber 22 through the Pd port 51 and the upstream section of the supply passage 28. A Pc port 52 radially extends from the communication passage 47. The communication passage 47 is connected to the crank chamber 5 through the downstream section of the supply passage 28 and the Pc port 52. Therefore, the Pd port 51, the valve chamber 46, the communication passage 47 and the Pc port 52 are formed in the control valve and form a part of the supply passage 28, which connects the discharge chamber 22 with the crank chamber 5.

The valve body 43 of the rod 40 is located in the valve chamber 46. The diameter d1 of the communication passage 47 is greater than the diameter d2 of the coupler portion 42 and smaller than the diameter d3 of the guide portion 44. Thus, a step is formed between the valve chamber 46 and the communication passage 47. The step functions as a valve seat 53, and the communication passage 47 functions as a valve hole. When the rod 40 is moved from the position of FIG. 3, or the lowermost position, to the uppermost position, at which the valve body 43 contacts the valve seat 53, the communication passage 47 is disconnected from the valve chamber 46. That is, the valve body 43 is an inlet valve body that controls the opening size of the supply passage 28.

A movable wall 54 is located in the pressure sensing chamber 48. The movable wall 54 divides the pressure sensing chamber 48 into a first pressure chamber 55 and a second pressure chamber 56. The movable wall 54 does not permit fluid to move between the first pressure chamber 55 and the second pressure chamber 56. The cross-sectional area SA of the movable wall 54 is greater than the cross-sectional area SB of the guide hole 49 (SB<SA).

The first pressure chamber 55 is constantly connected to the discharge chamber 22, which is the upstream pressure monitoring point P1, by a P1 port 55*a* formed in the cap 45*a* and the first passage 37.

The second pressure chamber 56 is constantly connected to the second pressure monitoring point P2 through a P2 port 56*a* formed in the upper portion 45*b* and the second passage 38. The first pressure chamber 55 is exposed to the discharge pressure Pd, which is the pressure PdH. The second pressure chamber 56 is exposed to the pressure PdL at the second pressure monitoring point P2. The upper side of the movable wall 54 receives the pressure PdH and the lower side receives the pressure PdL. The distal portion 41 of the rod 40 is located in the second pressure chamber 56. The distal end of the distal portion 41 is coupled to the movable wall 54. A spring 57 is located in the second pressure chamber 56. The spring 57 urges the movable wall 54 toward the first pressure chamber 55.

The solenoid (the actuator 100 for changing the target pressure difference) includes a cup-shaped cylinder 61, which is fixed in the lower portion 45*c*. A stationary iron core 62 is fitted into an upper opening of the cylinder 61. The stationary core 62 defines a solenoid chamber 63 in the cylinder 61. A movable iron core 64 is located in the solenoid chamber 63. The movable iron core 64 is moved axially. The stationary core 62 has a guide hole 65 through which the guide portion 44 extends. There is a clearance (not shown) between the guide hole 65 and the guide portion 44. The clearance communicates the valve chamber 46 with the solenoid chamber 63. Thus, the solenoid chamber 63 is exposed to the discharge pressure Pd, to which the valve chamber 46 is exposed.

The proximal portion of the rod 40 is located in the solenoid chamber 63. The lower end of the guide portion 44 is fitted into a hole formed in the center of the movable iron core 64. The movable iron core 64 is crimped to the guide portion 44. Thus, the movable core 64 moves integrally with the rod 40. A spring 66 is located between the stationary core 62 and the movable core 64. The spring 66 urges the movable core 64 and the rod 40 downward such that the movable core 64 moves away from stationary core 62.

A coil 67 is wound about the stationary core 62 and the movable core 64. The coil 67 receives drive signals from a drive circuit 72 based on commands from an ECU 70 for the engine E. The coil 67 generates an electromagnetic force F that corresponds to the value of the current from the drive circuit 72. The electromagnetic force F urges the movable core 64 toward the stationary core 62, which lifts the rod 40. The current to the coil 67 may be varied in an analog fashion. Alternatively, the current may be duty controlled, that is, the duty ratio Dt of the current may be controlled. In this case, a greater duty ratio Dt represents a smaller opening size of the control valve and a smaller duty ratio Dt represents a greater opening size of the control valve.

The opening size of the control valve is determined by the position of the rod 40. The rod 40 has the valve body 43, which functions as an inlet valve body. Forces acting on several parts of the rod 40 will now be explained to describe the operating conditions and the characteristics of the control valve.

The upper surface of the distal portion 41 receives a downward force, which is the resultant of the force fl of the spring 57 and the pressures acting on the upper and the lower sides of the movable wall 54. The pressure receiving area on the upper side of the wall 54 is represented by SA. The pressure receiving area of the lower side of the wall 54 is represented by (SA−SB). The pressure receiving area of the lower end of the distal portion 41 is represented by (SB−SC). The crank pressure Pc applies an upward force to the lower end of the distal portion 41. Assume downward forces have positive values. The sum ΣF1 of the forces acting on the distal portion 41 is represented by the following equation.

$$\Sigma F1=PdH\cdot SA-PdL(SA-SB)-f1-Pc(SB-SC) \qquad \text{Equation I}$$

A downward force f2 of the spring 66 and an upward electromagnetic force F act on the guide portion 44, which includes the valve body portion 43.

Figure 4:
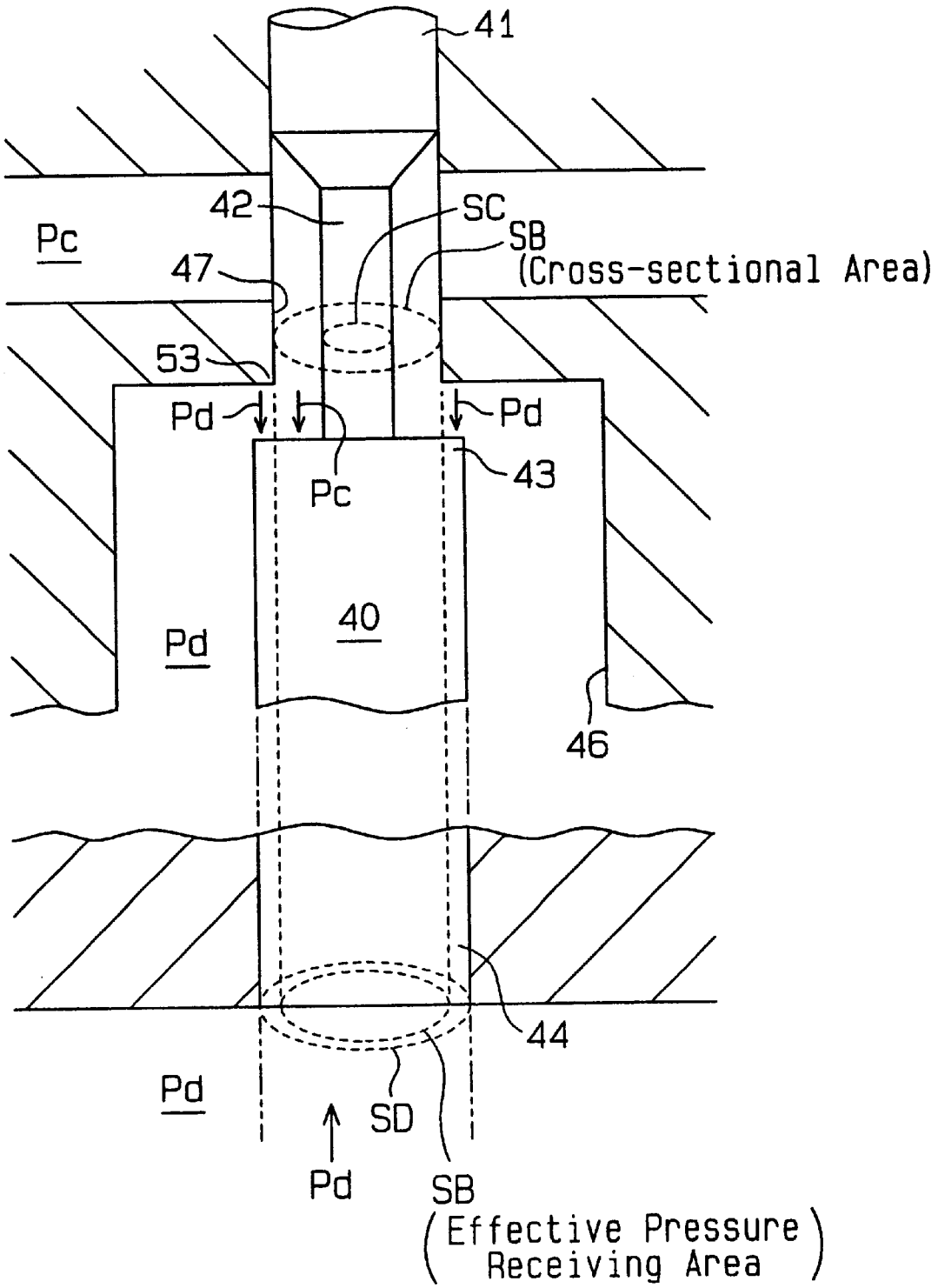
FIG. 4 is a schematic cross-sectional view showing an effective pressure receiving area of the control valve shown in FIG. 3.

The pressures that act on the exposed surfaces of the valve body 43, the guide portion 44 and the movable iron core 64 will now be described with reference to FIG. 4. The pressures are simplified as follows. First, the upper end surface of the valve body 43 is divided into the inside section and the outside section by an imaginary cylinder, which is shown by broken lines in FIG. 4. The imaginary cylinder corresponds to the wall of the communication passage 47. The crank pressure Pc acts in a downward direction on the inside section (area: SB−SC). The discharge pressure Pd acts in a downward direction on the outside section (area: SD−SB). Taking the pressure balance between the upper and lower surfaces of the movable iron core 64 into account, the discharge pressure Pd, to which the solenoid chamber 63 is exposed, acts on the area corresponding to the cross-sectional area SD of the guide portion 44 to urge the guide portion 44 upward. If the total force ΣF2 that acts on the valve body 43 and the guide portion 44, defining the upward direction as the positive direction, are summed, ΣF2 is expressed by the following equation.

$$\Sigma F2=F-f2-Pc(SB-SC)-Pd(SD-SB)+Pd\cdot SD=F-f2-Pc(SB-SC)+Pd\cdot SB \qquad \text{Equation II}$$

In the process of calculating equation II, −Pc·SD was canceled by +Pc·SD, and the term Pc·SB remained. That is, if the net force based on the discharge pressure Pd that acts on the upper and lower surfaces of the guide portion 44 is viewed as a force that acts on the lower surface of the guide portion 44, the effective pressure receiving area of the guide portion 44 regarding the discharge pressure Pd is equal to the area SB (SB=SD−(SD−SB)). As far as the discharge pressure Pd is concerned, the effective pressure receiving area of the guide portion 44 is equal to the cross-sectional area SB of the communication passage 47 regardless of the cross-sectional area SD of the guide portion 44. When pressures of the same kind act on both ends of a member such as a rod, the pressure receiving area having an effect that is not canceled is called the effective pressure receiving surface area.

Since the rod 40 is an integrated member formed by connecting the guide portion 44 to the distal portion 41 with coupler portion 42, its position is determined by the physical balance of ΣF1=ΣF2. In the equation ΣF1=ΣF2, the terms Pc(SB−SC) can be canceled. As a result, the following equation III is obtained.

$$(PdH-PdL)SA-Pd\cdot SB+PdL\cdot SB=F+f1-f2 \qquad \text{Equation III}$$

Since the first pressure monitoring point P1 is located in the discharge chamber 22, the pressure Pd is equal to the pressure PdH (Pd=PdH). If Pd is replaced by PdH, equation III is converted into the following equations IV and V.

$$(PdH-PdL)SA-(PdH-PdL)SB=F+f1-f2 \qquad \text{Equation IV}$$

$$PdH-PdL=(F+f1-f2)/(SA-SB) \qquad \text{Equation V}$$

In equation V, f1, f2, SA and SB are fixed parameters that are primarily defined in the steps of mechanical design, and the electromagnetic force F is a variable parameter that changes in accordance with the power supplied to the coil 67.

As apparent from equation V, the pressure difference ΔP(t) (ΔP(t)=PdH−PdL), is determined only by duty controlling the current supplied to the coil 67. That is, a target value TPD of the pressure difference is adjusted by externally controlling the control valve.

Equation V contains no pressure parameters such as the crank pressure Pc and the discharge pressure Pd, other than the pressure difference expressed by PdH−PdL. Thus, the crank pressure Pc and the discharge pressure Pd do not influence the position of the rod 40. In other words, pressure parameters other than the pressure difference do not affect the movement of the rod 40, and the control valve is regulated based only on the pressure difference ΔP(t), the electromagnetic force F and the spring forces f1, f2.

The opening size of the control valve is determined in the following manner. When no current is supplied to the coil 67, or when the duty ratio Dt is zero percent, the spring 66 positions the rod 40 at the lowest position shown in FIG. 3. The valve body 43 is spaced from the valve seat 53 by the greatest distance, which fully opens the control valve. When a current of the minimum duty ratio is supplied to the coil 67, the upward electromagnetic force F is greater than the downward force f2 of the spring 66. The net upward force (F−f2) generated by the solenoid and the spring 66 acts against the net downward force of the pressure difference (PdH−PdL) and the spring 57. As a result, the position of the valve body 43 relative to the valve seat 53 is determined such that equation V is satisfied, which determines the opening size of the control valve.

Accordingly, the flow rate of gas to the crank chamber 5 through the supply passage 28 is determined. Then, the crank pressure Pc is adjusted in accordance with the relationship between the flow rate of gas through the supply passage 28 and the flow rate of gas flowing out from the crank chamber 5 through the bleed passage 27. That is, controlling the opening size of the control valve controls the crank pressure Pc. When the electromagnetic force F is constant, the control valve functions as a constant flow rate valve and is actuated based on the target pressure difference TPD, which corresponds to the electromagnetic force F. However, since electromagnetic force F can be externally changed to adjust the target pressure difference TPD, the control valve can vary the displacement of the compressor.

Control System

Figure 5:
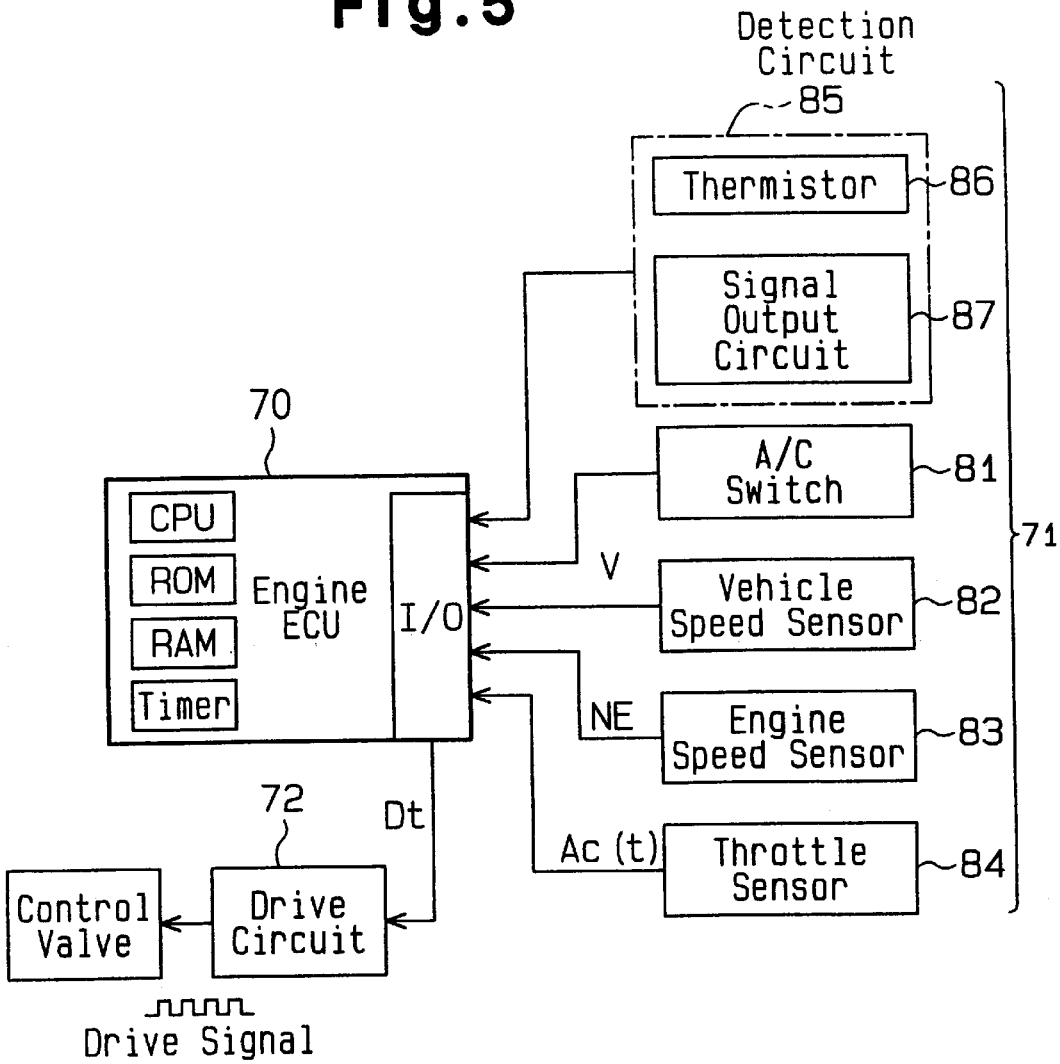
FIG. 5 is a block diagram showing a control system of the embodiment shown in FIG. 1.

As shown in FIGS. 2, 3 and 5, the control valve is connected to a pressure difference changer, which is an engine ECU 70 in this embodiment, through the drive circuit 72. The engine ECU 70 mainly controls the engine E. As shown in FIG. 5, the ECU 70 includes a CPU, a ROM, a RAM, a timer and an input-output interface circuit. The ROM stores various control programs (see flowcharts of FIGS. 7 to 10) and initial data. The RAM has a working memory area. The timer generates clock pulse signals by either hardware or software. The clock pulse signals are at least used as regular interruption signals for notifying the CPU of the starting time of regular interruption routines. The input-output interface circuit has input and output terminals. An external information detection apparatus 71 is connected to input terminals. The drive circuit 72 is connected to output terminals. The engine ECU 70 computes an appropriate duty ratio Dt based on the information from the apparatus 71 and commands the drive circuit 72 to output a drive signal having the computed duty ratio Dt. The drive circuit 72 outputs the instructed drive signal having the duty ratio Dt to the coil 67 of the control valve. The electromagnetic force F of the solenoid is determined according to the duty ratio Dt. Accordingly, the opening size of the control valve is continuously adjusted, which quickly changes the crank pressure Pc and the stroke of each piston 20. The piston stroke represents the compressor displacement and the torque.

The external information detection apparatus 71 includes various sensors. The sensors of the detection apparatus 71 may include, for example, an A/C switch 81, a vehicle speed sensor 82, an engine speed sensor 83, a throttle sensor (or an acceleration pedal sensor) 84 and a detection circuit 85. The A/C switch 81 is an ON/OFF switch of the air conditioner operated by a passenger. The A/C switch 81 provides the engine ECU 70 with information regarding the ON/OFF state of the air conditioner. The vehicle speed sensor 82 and the engine speed sensor 83 provide the engine ECU 70 with information regarding the vehicle speed V and the engine speed NE. The throttle sensor 84 detects the inclination angle, or the opening size, of a throttle valve located in the intake passage of the engine. The throttle opening size represents the degree of depression Ac(t) of the acceleration pedal in the vehicle.

The detection circuit 85 is located in the vicinity of the evaporator 33 (see FIG. 2) and provides the engine ECU 70 with information regarding the temperature in the vicinity of the evaporator 33. The temperature information will be referred to as a detection circuit signal. The temperature in the vicinity of the evaporator 33 corresponds to the temperature of the surface of the evaporator 33 and to the temperature of the passenger compartment. The detection circuit 85 includes a temperature sensor, which is a thermistor 86 in this embodiment, for monitoring the temperature in the vicinity of the evaporator 33 and a signal output circuit 87 for generating and outputting the detection circuit signal based on changes of the resistance of the thermistor 86.

Figure 6:
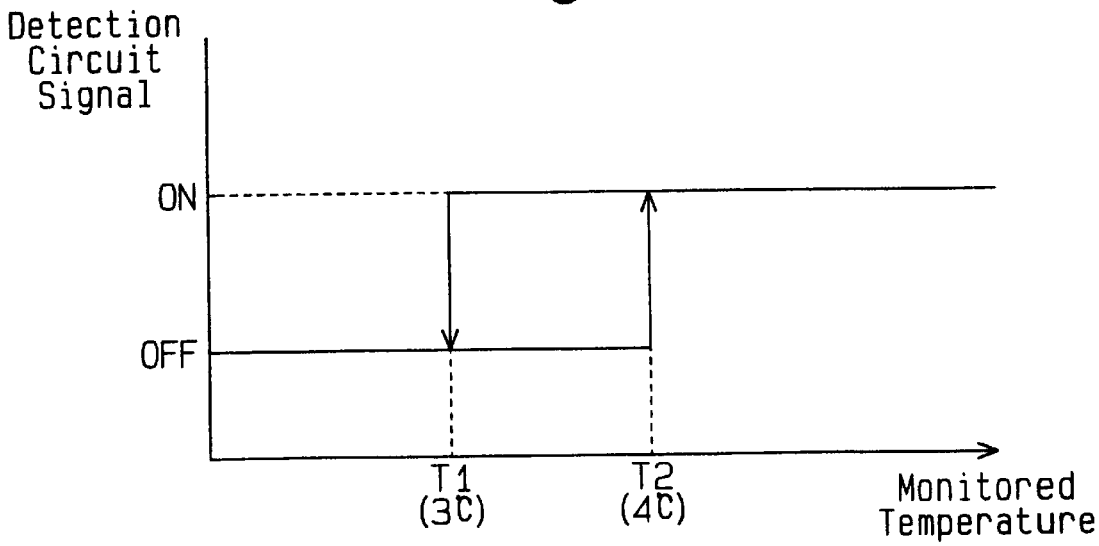
FIG. 6 is a graph showing the relationship between a detection circuit signal and a monitored temperature.

The signal output circuit 87 compares the monitored temperature with threshold temperatures. When the monitored temperature falls below one of the threshold temperatures or surpasses another, the circuit 87 outputs the detection circuit signal. FIG. 6 shows the relationship between the monitored temperature and the detection circuit signal. The threshold temperatures are a lower limit temperature T1 (for example, three degrees centigrade) and an upper limit temperature T2 (for example, four degrees centigrade). The monitored temperature rises due to changes in the relationship between the flow rate of the refrigerant in the evaporator and the compartment temperature. When the monitored temperature surpasses the upper limit temperature T2, the signal output circuit 87 outputs an ON signal (a rising signal).

When the monitored temperature falls below the lower limit temperature T1, the signal output circuit 87 outputs an OFF signal (falling signal). Since the determination values differ when the signal is switched from OFF to ON from when the signal is switched from ON to OFF, there is a hysteresis. The threshold temperatures, which are three degrees centigrade and four degrees centigrade in this embodiment, are determined such that air sent to the passenger compartment is sufficiently cooled without forming frost the evaporator. Frost on the evaporator reduces the cooling efficiency.

A controller of the compressor at least includes the engine ECU 70, the detection circuit 85 and the control valve.

Duty control procedure by the ECU 70 will be described with reference to flowcharts and timing charts (FIGS. 7 to 13). The ECU 70 normally controls the engine E by, for example, controlling the fuel supply amount. In addition, the ECU 70 regularly and irregularly performs interruptions for controlling the air conditioner.

Figure 7:
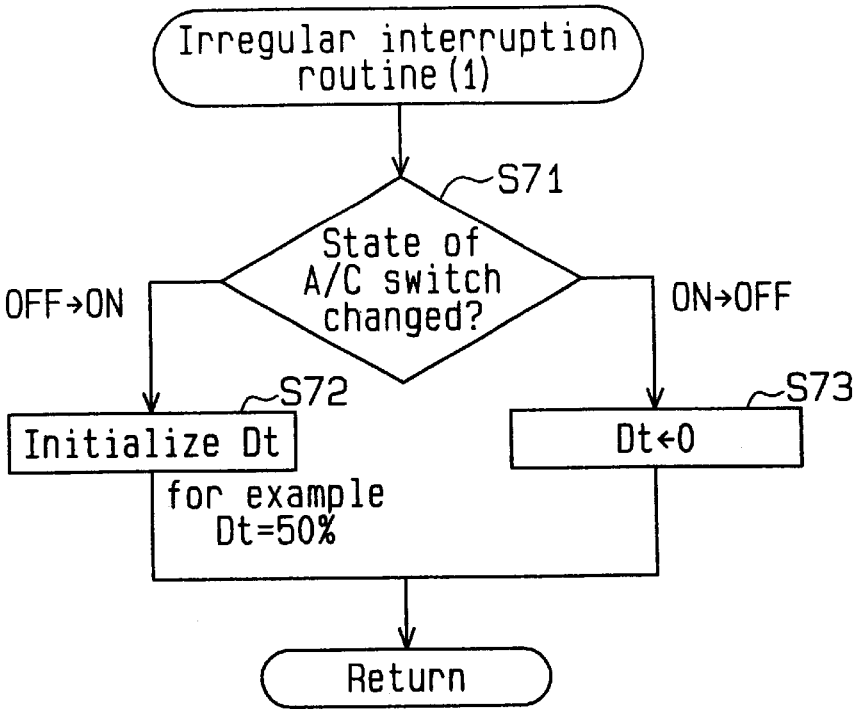
FIG. 7 is a flowchart showing an irregular interruption routine (1)

FIG. 7 is a flowchart of an irregular interruption routine (1), which is executed for starting and stopping air conditioning. When the A/C switch 81 is turned on or off and a signal representing the switching reaches the engine ECU 70, the ECU 70 judges that there is an interrupt request. In this case, the ECU 70 stops controlling the engine E and starts the irregular interruption routine (1).

If the A/C switch 81 is switched from OFF to ON in step S71, the ECU 70 moves to step S72. In step S72, the ECU 70 initializes the duty ratio Dt. That is, the ECU 70 sets the duty ratio Dt to an initial value Dt(ini), which is, for example, fifty percent. The opening size of the control valve corresponds to the initial duty ratio Dt(ini). The crank pressure Pc is changed accordingly and the compressor displacement is set to a predetermined initial level.

If the A/C switch 81 is switched from ON to OFF in step S71, the ECU 70 moves to step S73. In step S73, the ECU 70 sets the duty ratio Dt to zero, which maximizes the opening size of the control valve. Accordingly, the crank pressure Pc is quickly increased and the inclination angle θ is minimized. The compressor displacement is thus minimized. After either steps S72, S73, the ECU 70 terminates the interruption and starts controlling the engine E again.

Figure 8:
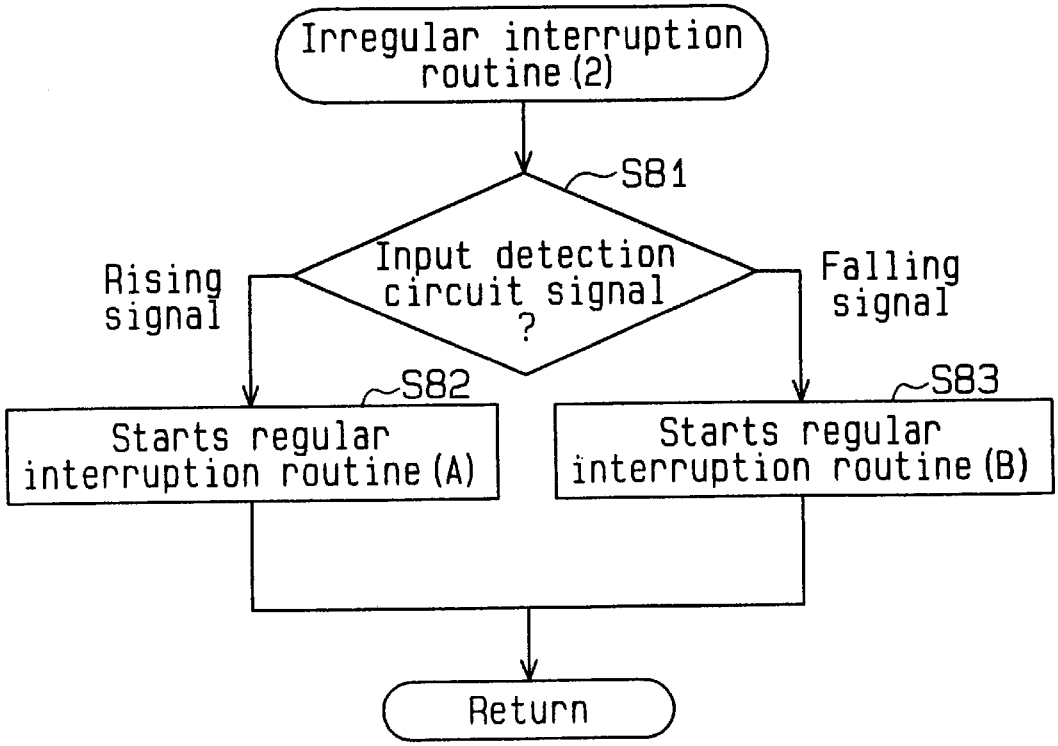
FIG. 8 is a flowchart showing an irregular interruption routine (2)
Figure 9:
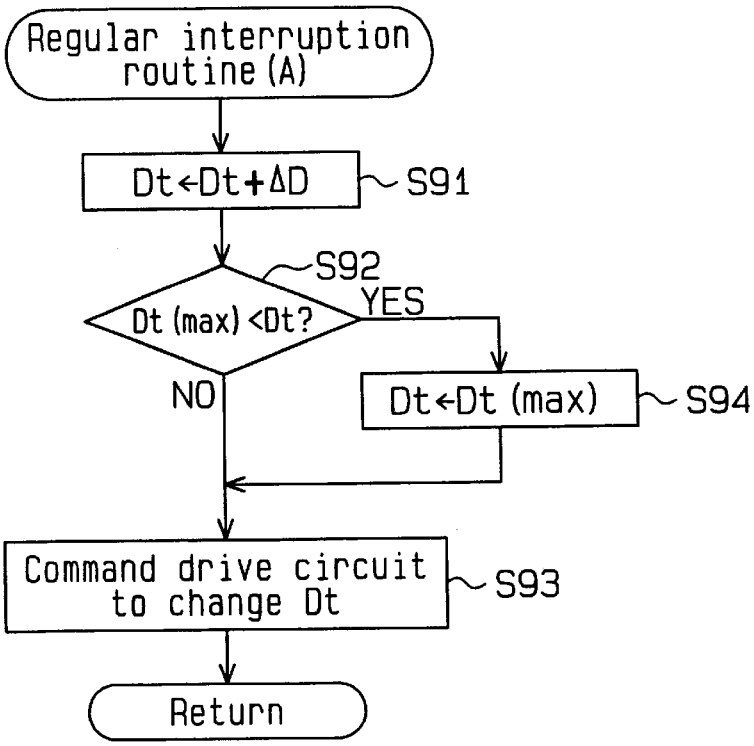
FIG. 9 is a flowchart showing a regular interruption routine (A)
Figure 10:
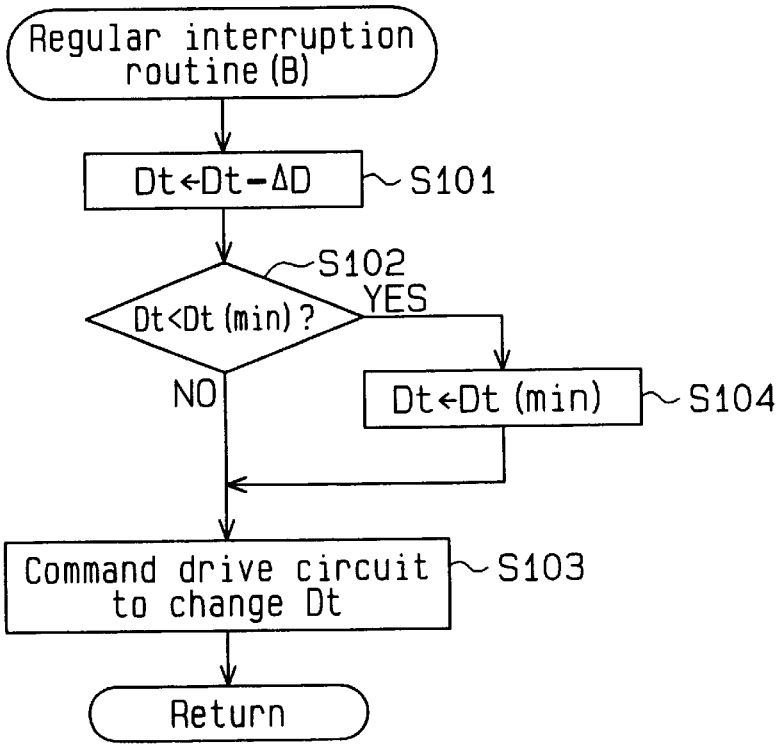
FIG. 10 is a flowchart showing a regular interruption routine (B)

FIG. 8 is a flowchart of an irregular interruption routine (2), which is executed when the A/C switch is on. When the signal from the detection circuit 85 changes, the engine ECU 70 judges that there is an interruption request. In this case, the ECU 70 stops controlling the engine E and starts the irregular interruption routine (2). If the ECU 70 receives a rising signal in step S81, the ECU 70 moves to step S82. In step S82, the ECU 70 starts regular interruption routine (A), which is shown in FIG. 9. If the ECU 70 receives a falling signal in step S81, the ECU 70 moves to step S83. In step S83, the ECU 70 starts a regular interruption routine (B), which is shown in FIG. 10. After executing either steps S82 and S83, the ECU 70 terminates the interruption routine (2) and starts controlling the engine E again.

When the duty ratio Dt is the initial value Dt(ini), the compressor displacement is changed, which lowers the temperature in the vicinity of the evaporator 33. When the monitored temperature falls below the lower limit temperature T1, the ECU 70 receives a falling signal from the detection circuit 85 and thus starts the routine (B). The ECU 70 regularly repeats the routine (B) until the ECU 70 receives a rising signal and starts the routine (A). The routine (B) is executed in synchronization with clock signals from the timer.

When the engine ECU 70 stops controlling the engine E and starts the routine (B), the ECU 70 decreases the current duty ratio Dt by an amount ΔD in step S101. A decrease in the duty ratio Dt represents a decrease of the target pressure difference TPD and a decrease of the refrigerant flow rate or a decrease in the compressor displacement. Accordingly, the air conditioning is controlled to lessen cooling.

In step S102, the ECU 70 judges whether the current duty ratio Dt, which was computed by subtracting the amount ΔD from the previous duty ratio Dt, is smaller than a predetermined lower limit value Dt(min). If the outcome of step S102 is negative, the current duty ratio Dt is greater than the lower limit value Dt(min). In this case, the ECU 70 moves to step S103 and commands the drive circuit 72 to change the duty ratio Dt, which slightly weakens the electromagnetic force F. Accordingly, the target pressure difference TPD is slightly lowered.

Then, since balance between the forces on the rod 40 is not achieved with the current pressure difference ΔP(t), the rod 40 is moved downward, which reduces the force applied by the spring 66. Thus, the reduced downward force f2 of the return spring 66 is countered by the reduced upward electromagnetic force F, and the valve body 43 is positioned such that equation V is satisfied again. As a result, the opening size of the control valve, that is, the opening size of the supply passage 28, is increased, which increases the crank pressure Pc. Accordingly, the difference between the crank pressure Pc and the pressure of the cylinder bores 1*a* increases, and the inclination angle θ of the swash plate 12 is decreased. Accordingly, the compressor displacement is decreased. When the discharge displacement of the compressor is decreased, the heat reduction performance of the evaporator 33 is also reduced, the passenger compartment temperature, or the monitored temperature, is increased, and the pressure difference between the points P1 and P2 is decreased.

If the outcome of step S102 is positive, the ECU 70 sets the duty ratio Dt to the lower limit value Dt(min) in step S104 and commands the drive circuit 72 to operate at the lower limit value Dt(min) in step S103. The lower limit value Dt(min) may be zero.

Figure 12:
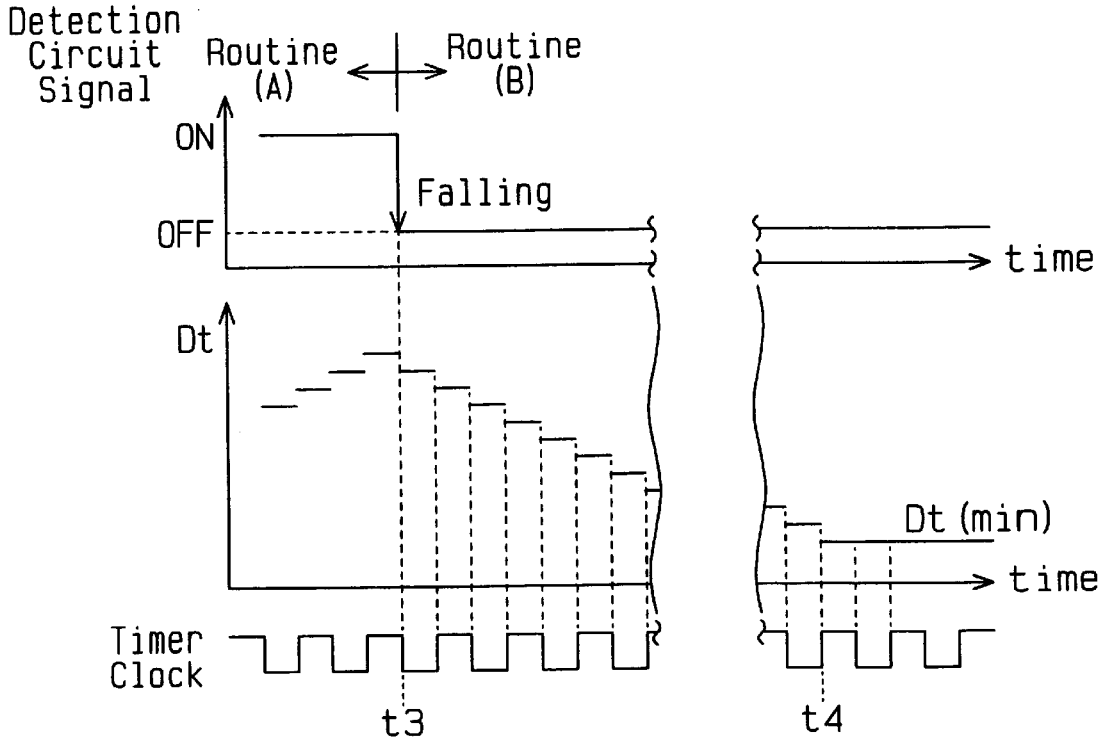
FIG. 12 is a timing chart showing the relationship between a duty ratio Dt and a detection circuit signal (a falling signal)

As the routine (B) is repeated, the duty ratio Dt, or the target pressure difference TPD, is gradually decreased. The timing chart of FIG. 12 shows changes of the duty ratio Dt when the routine (B) is repeated. When receiving a falling signal from the detection circuit 85, the ECU 70 keeps gradually decreasing the duty ratio Dt by the amount ΔD at a time in synchronization with the timer clock until the ECU 70 receives a rising signal. Accordingly, the duty ratio Dt is gradually decreased to the lower limit value Dt(min) (see the graph of Dt from t3 to t4 in FIG. 12). Then, as long as the ECU 70 does not receive a rising signal from the detection circuit 85, the duty ratio Dt is maintained at the lower limit value Dt(min) (see t4 and after in the graph of FIG. 12).

A decrease in the duty ratio Dt decreases the compressor displacement and reduces the heat reduction performance of the evaporator 33. Accordingly, the compartment temperature, or the monitored temperature, is gradually increased. When the monitored temperature surpasses the upper limit temperature T2, the engine ECU 70 receives a rising signal from the detection circuit 85. The ECU 70 then repeats the regular interruption routine (A), which is shown in FIG. 9, until the ECU 70 receives a falling signal.

When the engine ECU 70 stops controlling the engine E and starts the routine (A), the ECU 70 increases the duty ratio Dt by the amount ΔD in step S91. An increase in the duty ratio Dt increases the target pressure difference TPD, which increases the refrigerant flow rate and the compressor displacement. Accordingly, the cooling performance is increased.

In step S92, the ECU 70 judges whether the current duty ratio Dt, which was computed by adding the amount ΔD to the previous duty ratio Dt, is greater than a predetermined upper limit value Dt(max). If the outcome of step S92 is negative, the current duty ratio Dt is smaller than the upper limit value Dt(max). In this case, the ECU 70 moves to step S93 and commands the drive circuit 72 to change the duty ratio Dt, which slightly strengthen, the electromagnetic force F. Accordingly, the target pressure difference TPD is slightly raised.

Then, since balance between the forces on the rod 40 is not achieved with the current pressure difference ΔP(t), the rod 40 is moved upward, which increases the force applied by the spring 66. Thus, the increased downward force f2 of the return spring 66 is countered by the increased upward electromagnetic force F, and the valve body 43 is positioned such that equation V is satisfied again. As a result, the opening size of the control valve, that is, the opening size of the supply passage 28, is decreased, which decreases the crank pressure Pc. Accordingly, the difference between the crank pressure Pc and the pressure of the cylinder bores 1*a* decreases, and the inclination angle θ of the swash plate 12 is increased. Accordingly, the compressor displacement is increased. When the discharge displacement of the compressor is increased, the heat reduction performance of the evaporator 33 is also increased, the passenger compartment temperature, or the monitored temperature, is decreased, and the pressure difference between the points P1 and P2 is increased.

Figure 11:
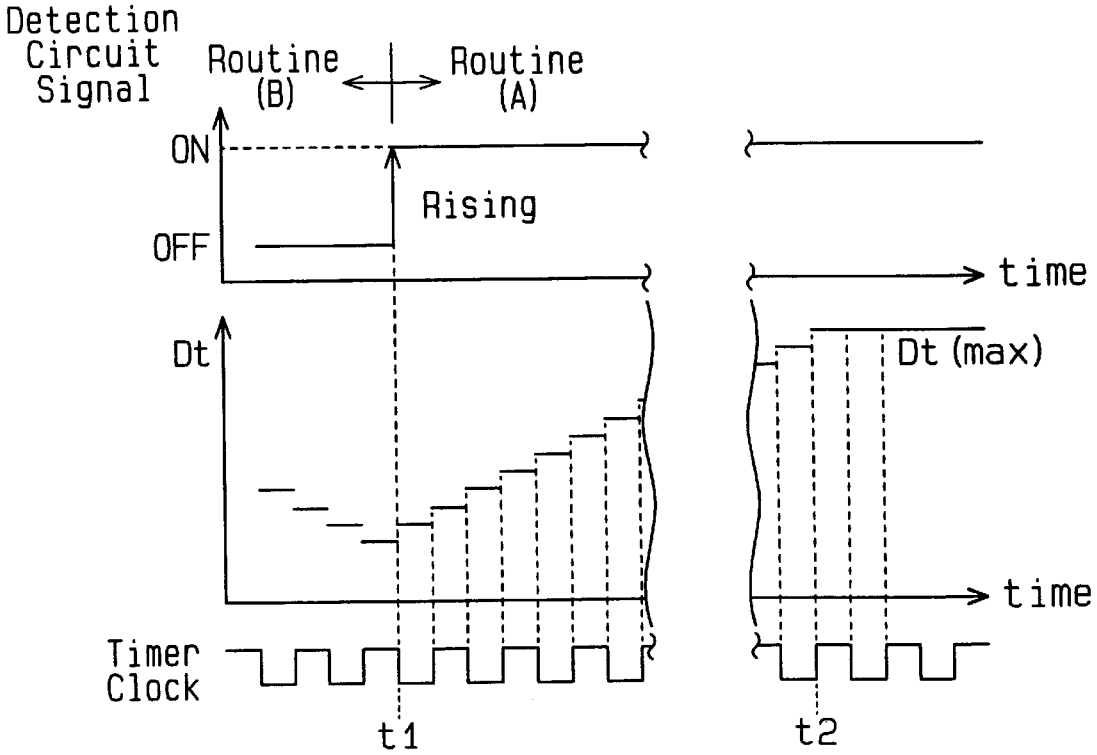
FIG. 11 is a timing chart showing the relationship between a duty ratio Dt and a detection circuit signal (a rising signal)

If the outcome of step S92 is positive, the ECU 70 sets the duty ratio Dt to the upper limit value Dt(max) in step S94 and commands the drive circuit 72 to operate at the upper limit value Dt(max) in step S93. As the routine (A) is repeated, the duty ratio Dt, or the target pressure difference TPD, is gradually increased. The timing chart of FIG. 11 shows changes of the duty ratio Dt when the routine (A) is repeated. When receiving a rising signal from the detection circuit 85, the ECU 70 gradually increases the duty ratio Dt by the amount ΔD at a time in synchronization with the timer clock until the ECU 70 receives a falling signal. Accordingly, the duty ratio Dt is gradually increased to the upper limit value Dt(min) (see the graph of Dt from t1 to t2 in FIG. 11). Then, as long as the ECU 70 does not receive a rising signal from the detection circuit 85, the duty ratio Dt is maintained at the upper limit value Dt(max) (see t2 and after in the graph of FIG. 11).

An increase in the duty ratio Dt increases the compressor displacement and increases the heat reduction performance of the evaporator 33. Accordingly, the compartment temperature, or the monitored temperature, is gradually decreased. When the monitored temperature falls below the lower limit temperature T1, the ECU 70 then repeats the regular interruption routine (B), which is shown in FIG. 10, until the ECU 70 receives a rising signal.

The engine ECU 70 continues to gradually increase or decrease the duty ratio Dt, or the target suction pressure TPD, until the ECU 70 receives a signal (a detection circuit signal) that indicates the monitored temperature crosses one of the threshold temperatures from the detection circuit 85. When receiving such a signal, the ECU 70 reverse the changing direction of the target pressure difference TPD. Thus, the target pressure difference TPD (duty ratio Dt) is alternately increased and decreased.

Figure 13:
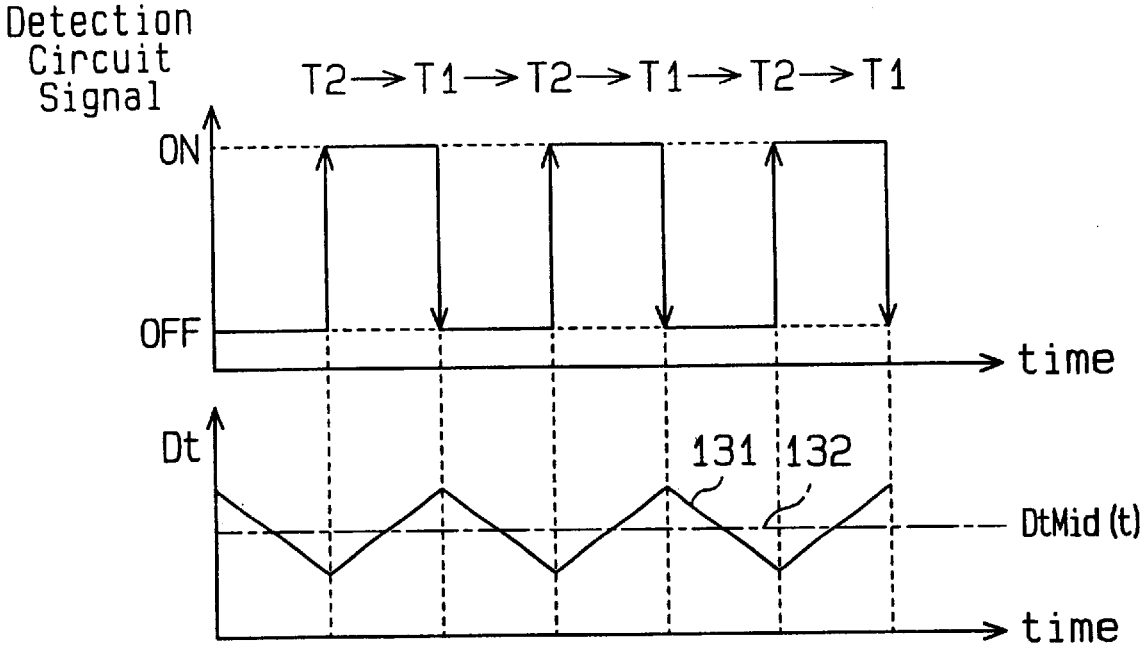
FIG. 13 is a timing chart showing the relationship between a duty ratio Dt and detection circuit signals (rising signals and falling signals).

If there is no abrupt changes of thermal load, the increases and decreases of the duty ratio Dt, the duty ratio Dt changes along line 131 in the timing chart of FIG. 13 from a macroscopic viewpoint. Changes of the monitored temperature, or increases and decreases of the monitored temperature between the threshold temperatures T1 and T2, the detection circuit 85 alternately outputs rising signals and falling signals. Every time the circuit 85 switches between a rising signal and a falling signal, the duty ratio Dt repeats increases and decreases with a constant amplitude above and below a center value DtMid(t). The center value DtMid(t) may be variable or constant. For example, a dashed line 132 represents the center value DtMid(t). In other words, while the engine ECU 70 changes the detection circuit signal between On and OFF in a binary fashion, which maintains the duty ratio Dt in the vicinity of the center value DtMid(t) in a certain amplitude.

As described above, the duty ratio Dt, or the pressure difference TPD, is quickly adjusted when the thermal load on the evaporator 33 is changed. The flow rate of refrigerant is adjusted accordingly, which maintains the temperature in the vicinity of the evaporator 33 at a temperature suitable for cooling the passenger compartment.

The illustrated embodiment has the following advantages.

The temperature in the vicinity of the evaporator 33 is maintained at a level suitable for cooling by a simple procedure. That is, the ECU 70 simply increases or decreases in response to a rising signal or a falling signal from the detection circuit 85. In other words, the procedures for optimizing the temperature in the vicinity of the evaporator 33 are sufficiently simple to be performed as interruptions by the ECU 70, which reduces the calculation load on the ECU 70. Thus, there is no need for an expensive controller specialized for air conditioning, and the engine ECU 70, which is mainly used for controlling the engine E, is used for air conditioning.

In the illustrated embodiment, the threshold temperatures, which are compared with the temperature monitored by the detection circuit 85, include the lower and upper limit temperatures T1, T2. Also, there is a hysteresis in which the temperature at which a rising signal is generated is different from the temperature at which a falling signal is generated. If there is only one threshold temperature, hunting may occur. Compared to a system having a single threshold temperature, the illustrated embodiment stably controls the compressor displacement without applying an excessive load on the compressor. Hunting of the detection circuit 85 refers to a case where the monitored temperature surpasses and falls below a single threshold temperature and the resulting detection circuit signals are excessively generated during a short time.

The suction pressure Ps is greatly influenced by changes in the thermal load on the evaporator 33. In the illustrated embodiment, the suction pressure Ps is not directly referred to for controlling the opening size of the displacement control valve. Instead, the pressure difference $\Delta P(t)$($\Delta P(t)$= PdH−PdL) between the two pressure monitoring points P1 and P2 is directly controlled for feedback controlling the compressor displacement.

Therefore, the compressor displacement is quickly controlled from the outside without being influenced by the thermal load on the evaporator 33.

The control valve shown in FIG. 3 functions as an internally controlled valve. Specifically, as long as the electromagnetic force F is constant, the control valve shown in FIG. 3 maintains the target pressure difference TPD, which is determined by the forces F, f1, f2 and the areas SA, SB, and automatically controls the compressor displacement to a level that corresponds to the target pressure difference TPD. The electromagnetic force F can be externally changed for changing the target pressure difference TPD. The compressor displacement is changed accordingly.

It should be apparent to those skilled in the art that the present invention may be embodied in many other specific forms without departing from the spirit or scope of the invention. Particularly, it should be understood that the invention may be embodied in the following forms.

The thermistor 86 and the signal output circuit 87 in the detection circuit 85 may be integrated or separated. If the thermistor 86 and the circuit 87 are separated, the thermistor 86 needs to monitor a temperature, which is the temperature of the evaporator 33 in the illustrated embodiment.

The upper limit value Dt(max) and the lower limit value Dt(min) of the duty ratio Dt, which are used in steps S94 and S104, need not be used.

The upper limit temperature T2 and the lower limit temperature T1 may be replaced by a single threshold temperature.

In the illustrated embodiment, the engine ECU 70 functions as the target pressure difference changer. However, the target pressure difference TPD may be changed by a separate controller. Compared to PI control and PID control, in which the target pressure difference is continuously and finely controlled, the control procedure of the illustrated embodiment is simple, which reduces the cost of the controller.

In the illustrated embodiment, the present invention is applied to a reciprocal piston type compressor. However, the present invention may be applied to rotary compressors such as a variable displacement scroll type compressor disclosed in Japanese Unexamined Patent Publication No. 11-324930.

In the illustrated embodiment, the upstream pressure monitoring point P1 is located in the discharge chamber 22, and the downstream pressure monitoring point P2 is located in the upstream pipe 36. However, the upstream pressure monitoring point P1 may be located in the downstream pipe 35 and the downstream pressure monitoring point P2 may be located in the suction chamber 21. Alternatively, the upstream pressure monitoring point P1 may be located either in the discharge chamber or the upstream pipe 36 and the downstream pressure monitoring point P2 may be located either in the suction chamber 21 or the downstream pipe 35. Also, the upstream pressure monitoring point P1 may be located either in the discharge chamber 22 and the upstream pipe 36 and the downstream pressure monitoring point P2 may be located in the crank chamber 5. Further, the upstream pressure monitoring point P1 may be located in the crank chamber 5 and the downstream pressure monitoring point P2 may be located either in the suction chamber 21 or the downstream pipe 35.

Therefore, the present examples and embodiments are to be considered as illustrative and not restrictive and the invention is not to be limited to the details given herein, but may be modified within the scope and equivalence of the appended claims.

What is claimed is:

1. A controller for a variable displacement compressor, wherein the compressor is used for air conditioning a compartment and includes a suction pressure zone, a discharge pressure zone, and a control chamber, which is connected to the suction pressure zone and to the discharge pressure zone, and wherein the pressure in the control chamber is adjusted for controlling the displacement of the compressor, the controller comprising:

a refrigerant circuit connected to the compressor, wherein two pressure monitoring points are located in the refrigerant circuit;

a control valve for controlling the pressure in the control chamber, wherein the control valve operates based on the actual pressure difference between the pressure monitoring points such that a target value of the pressure difference between the pressure monitoring points, which is externally determined, is maintained;

a detection circuit, wherein the detection circuit-includes a temperature sensor for monitoring a temperature that represents the temperature of the compartment, wherein the detection circuit produces a first detection signal when the sensed temperature exceeds a threshold value and a second detection signal when the sensed temperature falls below the threshold value; and a pressure difference changer, wherein, the pressure difference changer gradually increases the target value of the pressure difference when the first signal is received from the detection circuit and gradually decreases the target value of the pressure difference when the second signal is received from the detection circuit.

2. The controller according to claim 1, wherein the control valve causes the displacement of the compressor to increase when the target pressure difference is increased by the pressure difference changer, and the control valve causes the displacement of the compressor to decrease when the target pressure difference is decreased by the pressure difference changer.

3. The controller according to claim 1, wherein the compressor includes a cylinder bore, a piston reciprocally accommodated in the cylinder, a cam plate coupled to the piston and a crank chamber for accommodating the cam plate, wherein the crank chamber is the control chamber.

4. The controller according to claim 1, wherein the refrigerant circuit includes an evaporator, and wherein the temperature sensor is located in the vicinity of the evaporator.

5. The controller according to claim 1, wherein the compressor is driven by a vehicle engine, and wherein a controller of the engine functions as the pressure difference changer.

6. A controller for a variable displacement compressor, wherein the compressor is used for air conditioning a compartment and includes a suction pressure zone, a discharge pressure zone, and a control chamber, which is connected to the suction pressure zone and to the discharge pressure zone, and wherein the pressure in the control chamber is adjusted for controlling the displacement of the compressor, the controller comprising:

a refrigerant circuit connected to the compressor, wherein two pressure monitoring points are located in the refrigerant circuit;

a control valve for controlling the pressure in the control chamber, wherein the control valve operates based on the actual pressure difference between the pressure monitoring points such that a target value of the pressure difference between the pressure monitoring points, which is externally determined, is maintained;

a detection circuit, wherein the detection circuit includes a temperature sensor for monitoring a temperature that represents the temperature of the compartment, wherein the detection circuit produces a first detection signal when the sensed temperature exceeds an upper threshold value and a second detection signal when the sensed temperature falls below a lower threshold value;

a pressure difference changer, wherein, the pressure difference changer gradually increases the target value of the pressure difference when the first signal is received from the detection circuit and gradually decreases the target value of the pressure difference when the second signal is received from the detection circuit.

7. The controller according to claim 6, wherein the control valve causes the displacement of the compressor to increase when the target pressure difference is increased by the pressure difference changer, and the control valve causes the displacement of the compressor to decrease when the target pressure difference is decreased by the pressure difference changer.

8. The controller according to claim 6, wherein the compressor includes a cylinder bore, a piston reciprocally accommodated in the cylinder, a cam plate coupled to the piston and a crank chamber for accommodating the cam plate, wherein the crank chamber is the control chamber.

9. The controller according to claim 6, wherein the refrigerant circuit includes an evaporator, and wherein the temperature sensor is located in the vicinity of the evaporator.

10. The controller according to claim 6, wherein the compressor is driven by a vehicle engine, and wherein a controller of the engine functions as the pressure difference changer.

11. A controller for a variable displacement compressor, wherein the compressor is used for air conditioning a compartment and includes a suction pressure zone, a discharge pressure zone, and a control chamber, which is connected to the suction pressure zone and to the discharge pressure zone, and wherein the pressure in the control chamber is adjusted for controlling the displacement of the compressor, the controller comprising:

a refrigerant circuit connected to the compressor, wherein two pressure monitoring points are located in the refrigerant circuit;

a control valve for controlling the pressure in the control chamber, wherein the control valve operates based on the actual pressure difference between the pressure monitoring points such that a target value of the pressure difference between the pressure monitoring points, which is determined externally, is maintained;

a detection circuit, wherein the detection circuit includes a temperature sensor for monitoring a temperature that represents the temperature of the compartment, wherein the detection circuit produces a first detection signal when the sensed temperature exceeds an upper threshold value and a second detection signal when the sensed temperature falls below a lower threshold value; and a computer for receiving the first and second detection signals and for determining the target value of the pressure difference, wherein the computer gradually increases the target value of the pressure difference when the first signal is received from the detection circuit and gradually decreases the target value of the pressure difference when the second signal is received from the detection circuit.

12. The controller according to claim 11, wherein the control valve causes the displacement of the compressor to increase when the target pressure difference is increased by the computer, and the control valve causes the displacement of the compressor to decrease when the target pressure difference is decreased by the computer.

13. The controller according to claim 11, wherein the compressor includes a cylinder bore, a piston reciprocally accommodated in the cylinder, a cam plate coupled to the piston and a crank chamber for accommodating the cam plate, wherein the crank chamber is the control chamber.

14. The controller according to claim 11, wherein the refrigerant circuit includes an evaporator, and wherein the temperature sensor is located in the vicinity of the evaporator.

15. The controller according to claim 11, wherein the compressor is driven by a vehicle engine, and wherein the computer controls various engine functions.

* * * * *